United States Patent [19]

Cryor

[11] 3,934,389

[45] Jan. 27, 1976

[54] COIN COUNTING AND WRAPPING AID

[76] Inventor: Elliott C. Cryor, 1556 Moreland Ave., Baltimore, Md. 21216

[22] Filed: Dec. 13, 1974

[21] Appl. No.: 532,689

[52] U.S. Cl. ..... 53/213

[51] Int. Cl.[2] ..... B65B 11/04; B65B 11/48

[58] Field of Search ..... 53/212, 213, 254; 133/1 A

[56] References Cited

UNITED STATES PATENTS

| | | | |
|---|---|---|---|
| 2,163,509 | 6/1939 | Bagley | 53/213 |
| 2,533,144 | 12/1950 | Schneider | 53/213 |
| 2,590,241 | 3/1952 | Ewart | 53/213 |
| 3,710,544 | 1/1973 | Lamming | 53/213 |
| 3,783,586 | 1/1974 | Dorman | 53/213 |

*Primary Examiner*—Travis S. McGehee
*Assistant Examiner*—John Sipos
*Attorney, Agent, or Firm*—Cushman, Darby & Cushman

[57] ABSTRACT

An upwardly open box with a floor and three sides, is provided with a plurality of interchangeable fourth sides each with spacer means for determining the length and thus the number of coins of any denomination to be wrapped. The device includes a stand for the box, which holds the box at a compound tilt that obviates the need for springs. One box side is provided with a concave trough where the coins are to be disposed. The floor is provided with guide means for the wrapper and the lip of the box side opposite the one provided with the trough is provided with a slot for guiding the wrapper. Retainer means are provided on the box for removably holding the interchangeable fourth side in place while it is in use.

6 Claims, 4 Drawing Figures

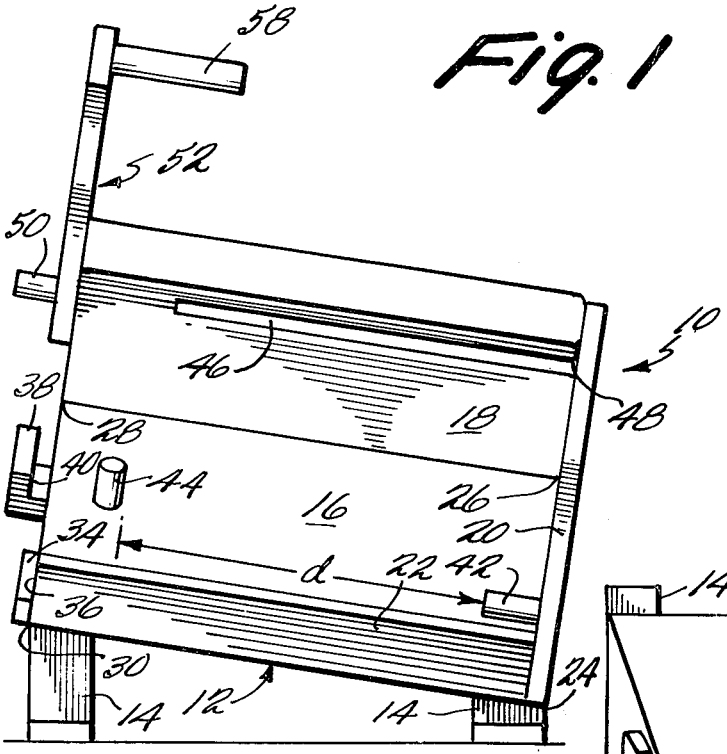
Fig. 1
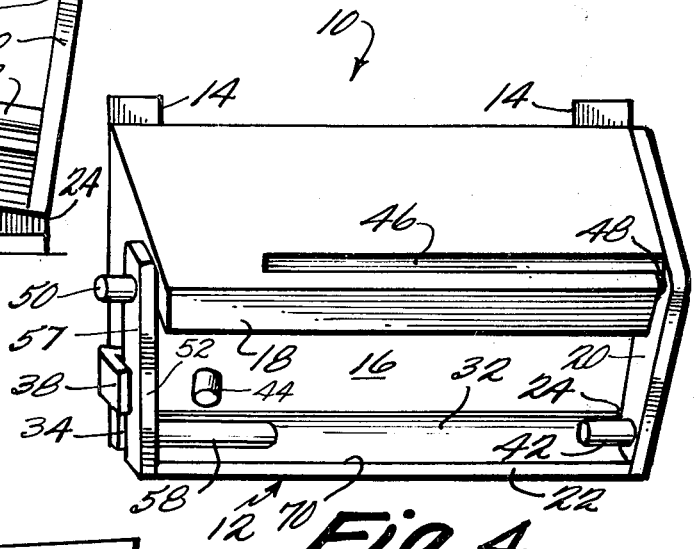
Fig. 4
Fig. 2
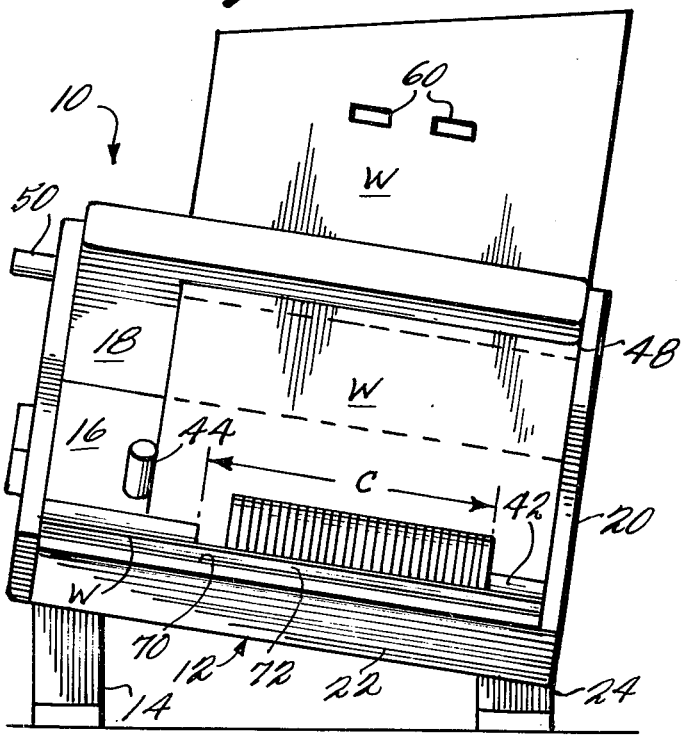
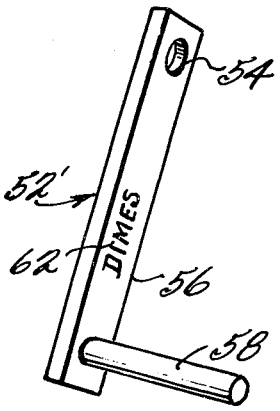
Fig. 3

COIN COUNTING AND WRAPPING AID

BACKGROUND OF THE INVENTION

Simple machines or jigs for assisting in the counting and wrapping of coins are well-known in the art, but have not achieved widespread usage.

SUMMARY OF THE INVENTION

An upwardly open box with a floor and three sides, is provided with a plurality of interchangeable fourth sides each with spacer means for determining the length and thus the number of coins of any denomination to be wrapped. The device includes a stand for the box, which holds the box at a compound tilt that obviates the need for springs. One box side is provided with a concave trough where the coins are to be disposed. The floor is provided with guide means for the wrapper and the lip of the box side opposite the one provided with the trough is provided with a slot for guiding the wrapper. Retainer means are provided on the box for removably holding the interchangeable fourth side in place while it is in use.

The principles of the invention will be further hereinafter discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the drawing:

FIG. 1 is a front elevation view of the device with one fourth wall pivoted upwardly about its mount;

FIG. 2 is a front elevation view of the device shown in the process of a coin counting and wrapping operation;

FIG. 3 is a perspective view of another fourth wall, by itself; and

FIG. 4 is a top plan view of the device.

DETAILED DESCRIPTION OF THE PRESENTLY PREFERRED EMBODIMENT

The coin counting and wrapping aid 10 is shown constituted by a generally rectangular, upwardly open box 12 mounted on a pedestal 14.

The box 12 includes a floor 16 and three fixed upstanding peripheral walls, including an upper sidewall 18, and end wall 20 and a lower sidewall 22.

The pedestal 14 disposes the box at a compound tilt, so that the floor (in the disposition depicted) is both tipped up so that the base of the side 18 is higher than the base of the side 22, and tipped up higher at the left than toward the right, so that the corner 24 is lowermost.

For example, the upper surface of the floor at corner 24 may be about 1 inch above the bottom of the pedestal 14, the corner 26 about 2.75 inches above the bottom of the pedestal 14, the corner 28 about 3.5 inches above the bottom of the pedestal and the corner 30 about 1.75 inches above the bottom of the pedestal.

It should now be noticed that the inner side 32 of the lower sidewall 22 is cylindrically concave, for instance, by that wall being constituted by a strip of quarter-concave molding such as is used for a cove base.

The floor 16 further includes a short leftward extension 34 beyond the left end 36 of the lower sidewall 22 and an upwardly projecting keeper 38 having its inner side 40 in line with the leftmost extent of the extension 34. (The elements 34 and 38 could be combined at the depicted site of either.)

The box 12 is shown further including an axially short dowel or peg 42 projecting leftwardly from the inner side of the right end wall 20. By preference, the dowel 42 projects about five-eighths inch leftwardly. A similar dowel or peg 44 projects normally of the floor 16 so that the distance d is just about four inches.

The upper sidewall 18 projects further above the floor 16 than does the right end wall 20, to provide room for a slot 46 which opens through the thickness of the sidewall 18. The slot 46 is also four inches long, is open at its rightmost extent at 48 and is longitudinally coextensive with the length *d.*

The left end of the upper sidewll 18 is provided with mounting means such as a dowel or peg 50, shown projecting leftwardly.

The box 12 is completed by any one of a plurality of interchangeable, removable and replaceable fourth sides 52, 52' (FIG. 3), etc., one for each kind of coins to be counted and sorted, e.g. pennies, nickels, dimes, quarters and halves. Each fourth sidewall includes means, such as an opening 54 through its thickness, for cooperating with the mounting means 50, a lower surface portion 56 to rest and be supported upon the floor extension 34, an outer surface 57 to be engaged by the keeper 38 to keep the removable end wall tight against the left ends of the upper and lower sidewalls 18, 22 and an inwardly projecting peg or dowel 58. The latter element projects toward and is in general longitudinal axial alignment with the dowl 42.

What is different among the fourth sidewalls 52, 52', etc., is that the dowels 58 are of differing length, so that the distance C between the closest approaches of the dowels 42 and 52 (or 42 and 52', etc.) toward one another is known for each fourth sidewall when installed.

The device 10 is constructed to be used with universal coin wrappers W of the sort which are e.g. four inches wide, regardless of the coin denomination to be wrapped therein, and which may include a pair of axially spaced windows 60 toward one end, and a printed legend, e.g., "This package contains in ", (the blanks being windows). Alternative legends are printed in double column rows near the opposite end of the wrapper, like so:

| | |
|---|---|
| $20 | $1 |
| $10 | 50¢ |
| $10 | 25¢ |
| $2 | 5¢ |
| 50¢ | 1¢ |
| $5 | 10¢ |

Accordingly, when e.g. a stack of nickels is wrapped tightly in the wrapper, the unique diameter of the stack will cause the windows 60 to align only with the row which reads "$2 5¢ ", so that the legend will be completed as follows, "This package contains $2 in 5¢ ". One such suitable wrapper known to the inventor is marked "Steel-Strong, Trademark Registered U.S. Pat. Off., Automatic Coin Wrapper, Patented May 31, 1921."

In operation, one wishing to count and wrap e.g. nickels, selects and installs the fourth sidewall 52 marked with indicia 62 indicating that it is the one to be used for nickels. A coin wrapper W is then slid into the slot 46 and advanced downwardly and forwardly, between the end wall 20 and the dowel 44, under the tips of the dowels 42 and 58 and up the concavely curved guiding surface 32 so that it protrudes upwardly beyond the upper edge 70 of the surface 32. Next, a stack of coins is placed generally horizontally on the wrapper upon the surface 32 with the lower, right end of the stack in contact with the dowel 42 and sufficient coins added to the upper, left end of the stack to close the space between the upper, right end of the stack and the tip of the dowel 58. Because the distance C equates to a stack of forty nickels, the coins need not be individually counted. Then the protruding end 72 of the wrapper W is grasped and convolutely wound about the stack.

Thus the dowels 44, 42 and 58 respectively provide first, second and third reference means for use in counting and wrapping the coins.

The dowel 50 is long enough that, upon rotatively lifting the fourth wall about the dowel 50 sufficiently to clear the keeper 38, the fourth wall may be retracted sufficiently to the left to permit the wrapped stack of coins to be withdrawn from the box, whereupon the open ends of the now tubular wrapper W may be conventionally twisted or folded flat against the stack. Thus, the fourth wall need not be completely removed to free a wrapped stack of coins.

The inventor has, so far, fabricated the device 10 of wood. However, in quantity production, the device 10 could be molded of conventional plastic material, perhaps as one piece, but for the interchangeable fourth walls which need to be separate therefrom. In particular, it should be noticed that no elaborate mechanisms and no springs are required for simple, sure operation of the device 10.

The device as shown could be made as a mirror image of itself so that, e.g. the left end wall is fixed and lower and the right end wall is interchangeable and higher, for instance, to accommodate persons having more manual dexterity in their left hand.

It should now be apparent that the coin counting and wrapping aid as described hereinabove possesses each of the attributes set forth in the specification under the heading "Summary of the Invention" hereinbefore. Because the coin counting and wrapping aid of the invention can be modified to some extent without departing from the principles of the invention as they have been outlined and explained in this specification, the present invention should be understood as encompassing all such modifications as are within the spirit and scope of the following claims.

In the claims:

1. A coin counting and wrapping aid, comprising:

a generally rectangular, upwardly open box constituted by a floor, two opposed sidewalls and an end wall;

pedestal means mounting the box so that one sidewall is higher than the other and the floor slopes downward both toward the lower one of the sidewalls and toward said end wall;

first reference means rising from said floor a predetermined distance from the inside of said end wall, said distance equating to the width of universal coin wrappers to be used with said aid;

at least two interchangeable fourth end walls for said box, each fourth end wall including means for removably, securely mounting it on said box at the opposite end thereof from the first-described end wall so that the first described and removably end walls are a fixed distance apart;

second reference means disposed on the inside of the first-described end wall near said lower sidewall with sufficient clearance from the floor that a wrapper may be slid therebelow; and third reference means on the inside of each fourth end wall and disposed near one end thereof to generally axially align with the second reference means when the respective fourth end wall is removably mounted on the box, the third reference means each being of extents toward the second reference means, when the respective fourth walls are removably mounted on the box, such as to provide fixed distances of characteristically different length when each fourth wall is removably mounted on the box, each fixed distance being substantially the same as the length of a generally horizontal complete stack of coins of like denomination.

2. The coin counting and wrapping aid of claim 1, further including means defining a concavely cylindrically curved inside surface extending along the lower sidewall of the box, whereby the generally horizontal stack of coins being counted and wrapped may rest thereagainst, with a leading end portion of the wrapper interposed between the stack and said curved inside surface.

3. The coin counting and wrapping aid of claim 1 wherein the means for removably, securely mounting each fourth end wall on the box includes:

means defining an axially disengageable, generally horizontal axis rotary joint between the adjacent end of the upper sidewall of the box and the inside of the other end of each fourth end wall;

means defining a fixed support on the box for the fourth end wall being used, positioned to engage that fourth end wall to support that fourth end wall in upstanding peripheral relation to the box floor; and means defining a keeper for preventing lateral movement, of the fourth end wall being used, away from peripheral relation to the box floor unless that fourth end wall is first rotated upwardly about said rotary joint substantially clear of said fixed support.

4. The coin counting and wrapping aid of claim 3 wherein the rotary joint comprises a pin mounted on the adjacent end of the upper sidewall and means defining an opening through said other end of each fourth end wall, whereby each such opening may be slipped over the pin when the respective fourth wall is being installed.

5. The coin counting and wrapping aid of claim 3 wherein each fourth wall bears indicia indicataing the denomination of coin with which it is to be used.

6. The coin counting and wrapping aid of claim 2 further including means defining a generally horizontal slot through the thickness of the upper sidewall, and of a length corresponding to the distance between the first reference means and the first-described end wall, whereby a wrapper may be slipped through the slot, and advanced down along the floor, to guided confinement between the first reference means and the first-described end wall, under the second and third reference means and to curve up said concavely cylindrically curved inside surface of the lower sidewall, so that when a generally horizontal stack of coins is placed on the wrapper where the wrapper traverses said curved surface, the leading end of the wrapper is disposed for convenient manual grasping to convolutely wind the wrapper about the generally horizontal stack of coins.

* * * * *